United States Patent [19]

O'Connell

[11] Patent Number: 4,795,417

[45] Date of Patent: Jan. 3, 1989

[54] APPARATUS AND METHOD FOR PLEATING FILM

[75] Inventor: David M. O'Connell, Tewksbury, Mass.

[73] Assignee: W. R. Grace & Co., Duncan, S.C.

[21] Appl. No.: 22,196

[22] Filed: Mar. 5, 1987

[51] Int. Cl.[4] ..... B31F 1/00

[52] U.S. Cl. ..... 493/439; 493/440; 493/447; 270/40

[58] Field of Search ..... 493/248, 438, 439, 440, 493/446, 447, 455, 456, 417, 460; 270/39, 40, 41

[56] References Cited

U.S. PATENT DOCUMENTS

| | | | |
|---|---|---|---|
| 1,698,665 | 1/1929 | Acton | 493/439 |
| 1,852,655 | 4/1932 | Jensen et al. | 493/440 |
| 2,873,965 | 2/1959 | Mitchell | 270/40 |
| 3,038,718 | 6/1962 | Balsam | 270/40 |
| 4,326,664 | 4/1982 | Benoit et al. . | |
| 4,607,830 | 8/1986 | Schumann . | |

FOREIGN PATENT DOCUMENTS

| | | | |
|---|---|---|---|
| 783467 | 4/1968 | Canada | 493/438 |

*Primary Examiner*—Frederick R. Schmidt
*Assistant Examiner*—Robert Showalter
*Attorney, Agent, or Firm*—John J. Toney; William D. Lee, Jr.; Mark B. Quatt

[57] ABSTRACT

Thermoplastic film is fed from a roll and pleated by passing the film across a series of rigid guides. As the film is drawn down across the guides, the film is pleated and then gathered onto a wind up roll. A J-shaped roll rack is preferably pneumatically activated to bring a fresh roll of film into a position for feeding the pleating arrangement.

6 Claims, 5 Drawing Sheets

APPARATUS AND METHOD FOR PLEATING FILM

BACKGROUND OF THE INVENTION

This invention relates generally to the processing of thermoplastic films and laminates, and more particularly to an apparatus and method for pleating or folding such films or laminates.

Thermoplastic films and laminates have a wide variety of uses, one of which is the use of such films and laminates as a storm window replacement. For retailing purposes, it is desirable that such materials be conveniently packaged in a relatively small display package, to be purchased and then unfolded by the customer at point of use.

One difficulty with this method of marketing such films is the fact that the original dimensions of the film are often much greater than the final dimensions desired for the commercial package. For example, a typical film useful for storm window applications is coextruded and ultimately wound onto a core with a width of 42". It is therefore clear that the film must be folded in such a manner that it can be accommodated in for example a 6" wide package for retail sales.

In the past, this original roll stock film could be center folded by means well known in the art, and then recenterfolded a second time, and perhaps a third time until the final reduced dimensions of the folded film were obtained. This process is costly and time consuming. It would be of great benefit to provide an apparatus and method for folding such roll stock films and laminates to the desired reduced dimension without the need for repetitive sequential center folding steps.

Of interest is U.S. Pat. No. 4,326,664 issued to Benoit et al and disclosing a thermoplastic bag in which pleats are introduced into certain portions of the bag by impressing the bag between matched metal rollers or plates having peaks or truncated peaks with matching recesses.

It is therefore an object of the present invention to provide an apparatus and method for pleating or folding film without the need for sequential center folding operations on the film prior to packaging the film in a final retail package.

It is also an object of the present invention to provide such an apparatus and method where roll stock film may be directly and continuously pleated or folded to the desired reduced width in a single operation.

SUMMARY OF THE INVENTION

The present invention is directed to an apparatus for feeding film from a roll and folding said film to a desired width, comprising a first series of rigid guides disposed substantially vertically at spaced intervals from each other, and closer together at their lower end than at their upper end; a second series of rigid guides interspersed between and at spaced intervals from the first series of guides, and horizontally offset from said first series of guides at their respective lower ends; means for supporting said guides; means for feeding said film from said roll, and past said guides, to cause folding of the film; and means for gathering said film.

In another aspect of the present invention, a method for feeding film from a roll and folding said film to a desired width comprises drawing the film from a roll to a vertically curved roller; drawing the film down over a horizontally curved member, and in contact with a first and second series of rigid guides disposed to create folds in the film as the film descends to a gathering means; and gathering said folded film.

The present invention also comprises an apparatus for loading a film roll comprising a film cradle; a frame for supporting said film cradle; pivoting means for moving said frame from an oblique position to a vertical position; first and second spindles located at either side of and in alignment with the film cradle; cone shaped end members on the ends of the spindles facing the film cradle; and means for forcing the end members into engagement with the core of the roll to raise the roll off the cradle.

In another aspect, a method of loading a film roll comprises placing the roll on a film cradle supported on a frame; raising the frame to a vertical position; and activating a forcing means for raising the roll from the film cradle.

The present invention additionally comprises an accordion-folded thermoplastic film folded by the process described herein above.

BRIEF DESCRIPTION OF THE DRAWINGS

Further details are given below with reference to the drawings wherein.

DESCRIPTION OF THE PREFERRED EMBODIMENTS

Figure 1:
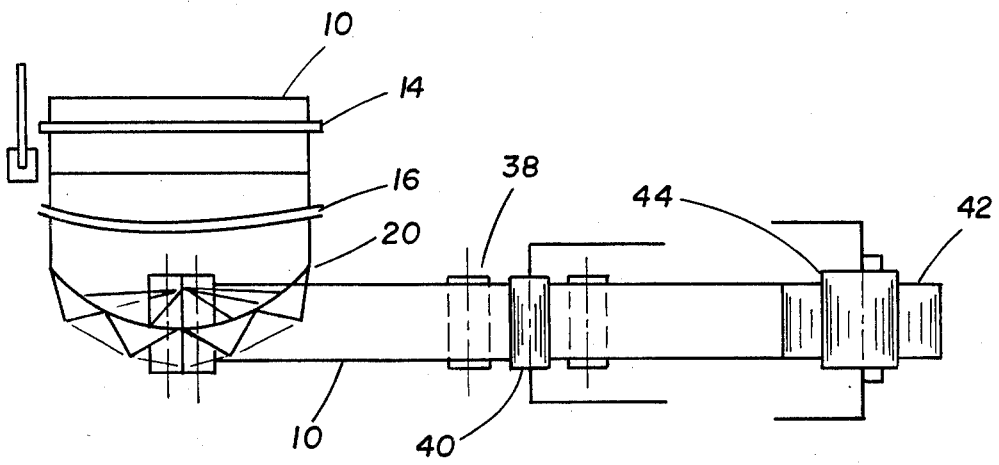
FIG. 1. is a schematic plan view of a film folder and associated apparatus in accordance with the present invention.
Figure 2:
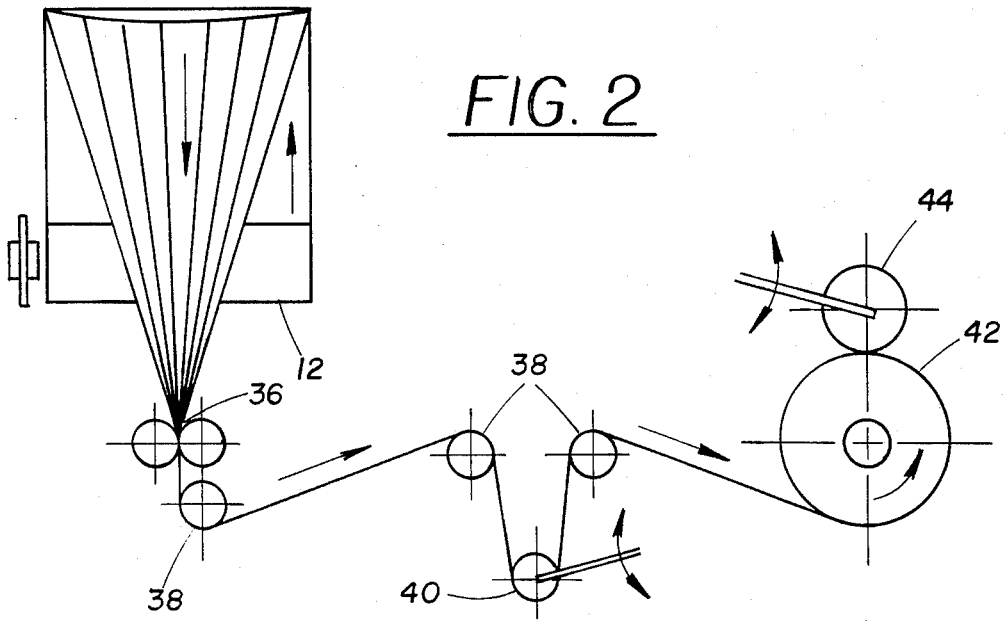
FIG. 2. is a front view of the film folder and apparatus of FIG. 1.

Referring specifically to the drawings, in FIG. 1, a plan or top view of the film pleater of the invention is shown in schematic fashion.

Figure 3:
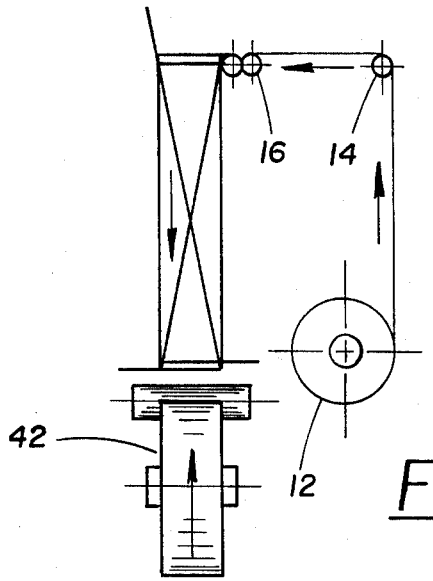
FIG. 3. is a side view of the film folder and apparatus of FIG. 1.

The film 10 fed from a roll 12 is fed vertically up to a first feed roll 14 and redirected over feed roll 14 and along a horizontal plane toward a vertically curved roller 16 (see FIG. 3).

This vertically curved roller 16 may be for example a roller commercially available and known as a Mount Hope roller, well known in the art for conveying film in a manner to keep the film spread out and prevent wrinkling and buckling of the film during conveyance.

Figure 4:
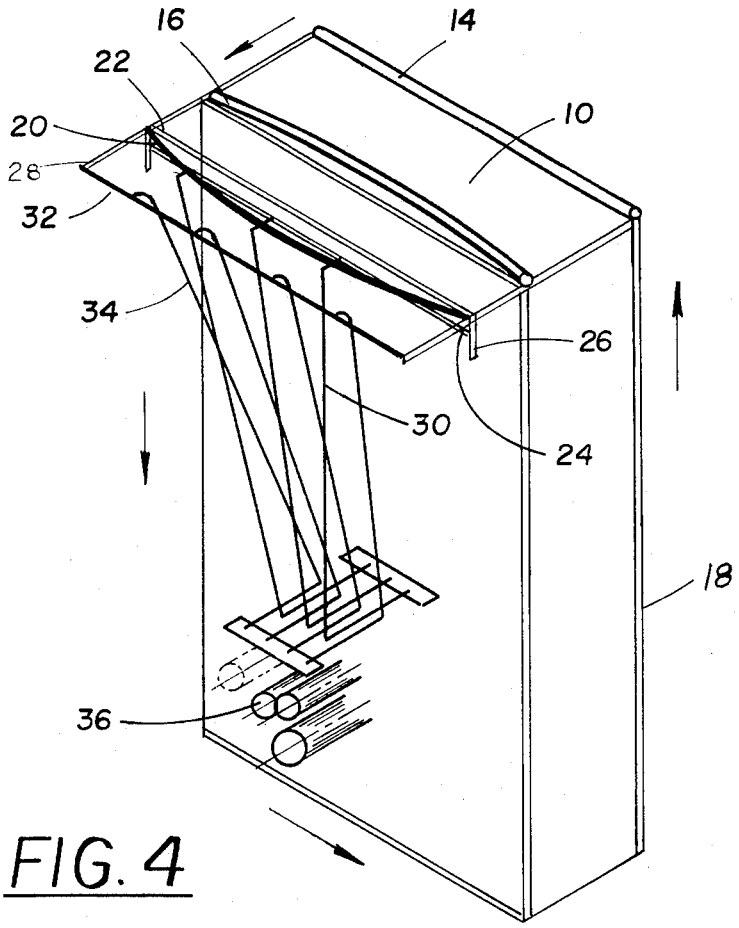
FIG. 4. is a perspective view of a film folder in accordance with the invention.
Figure 5:
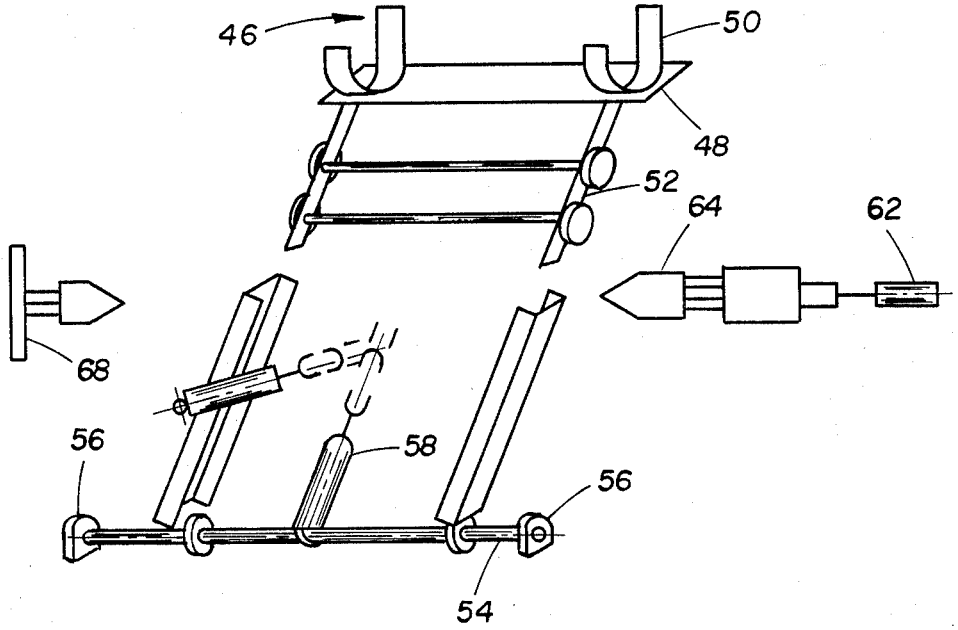
FIG. 5. is a perspective view of a film loader in accordance with the present invention.
Figure 6:
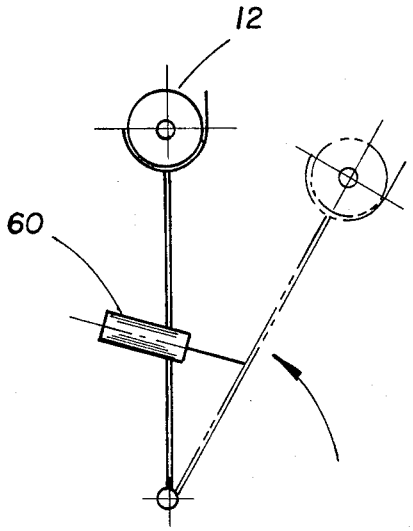
FIG. 6. is a side view of a first step in loading a film roll onto a cradle of the film loader.
Figure 7:
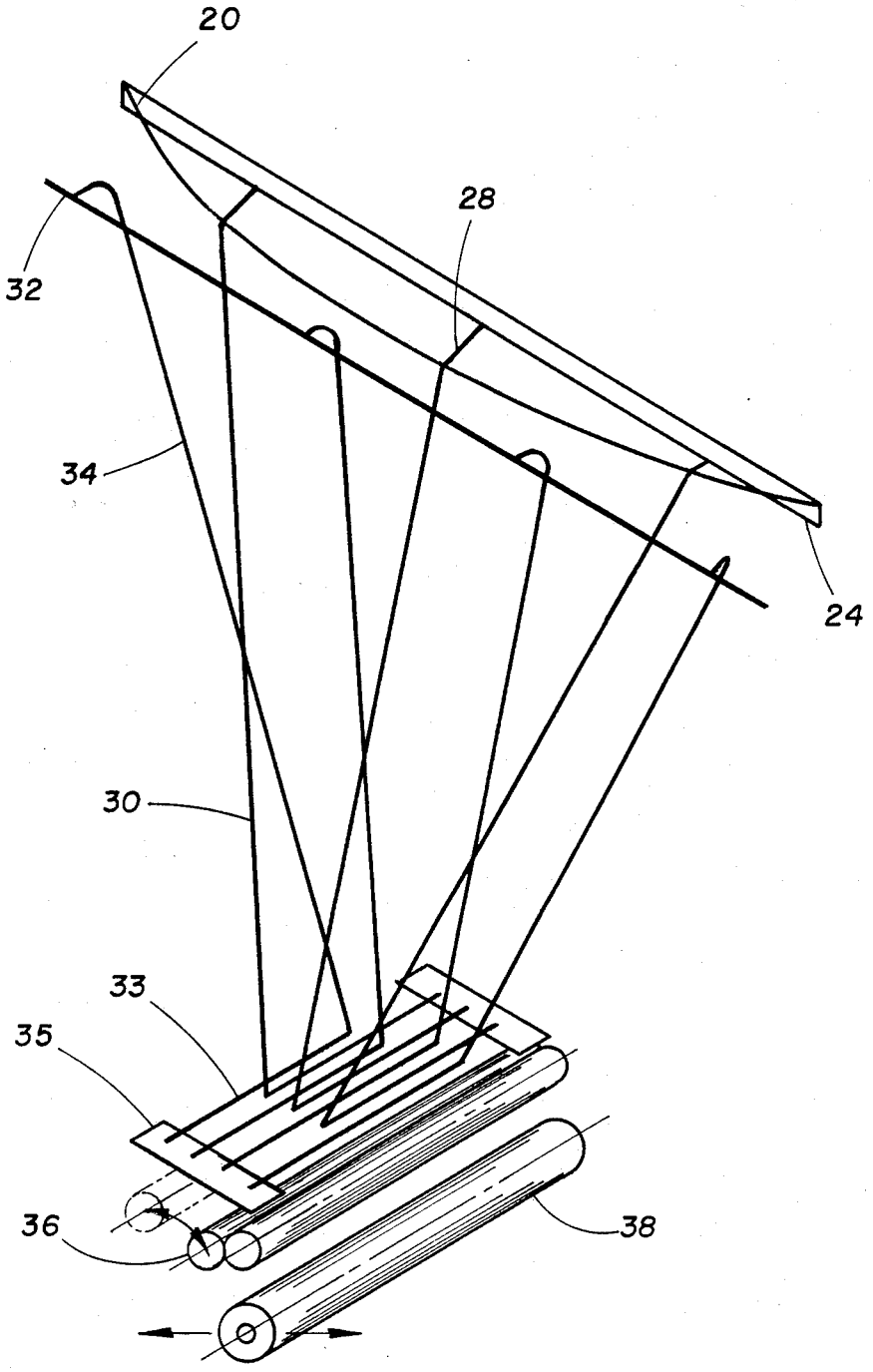
FIG. 7. is a perspective view of a portion of the film folder.
Figure 8:
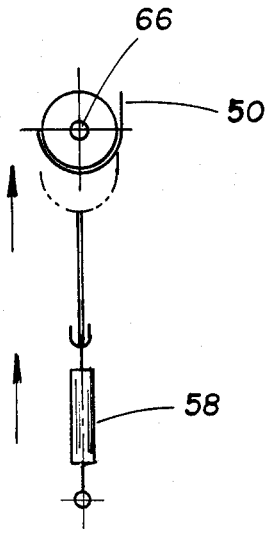
FIG. 8. is an optional third step in loading the film showing raising of the film loader.
Figure 9:
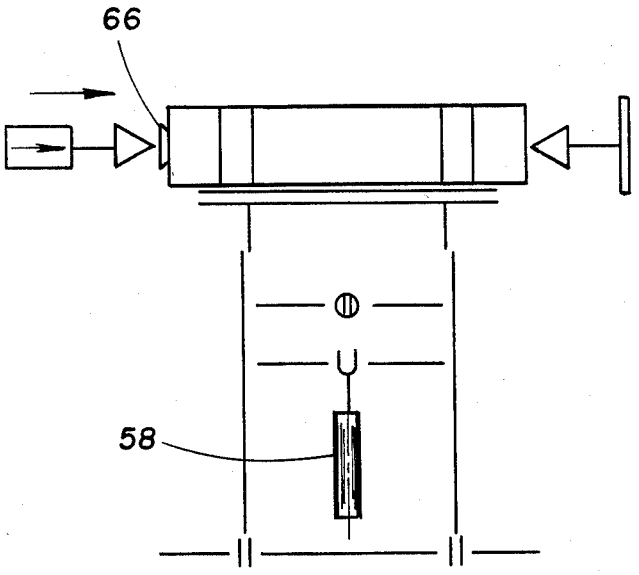
FIG. 9. is an elevational view of the final step of raising the film roll from the cradle.

As best shown in FIG. 4, feed roll 14 and curvd roller 16 are attached at their ends, by suitable journal or other bearing means, to the frame 18 of the film pleater.

For the sake of clarity, structural members of the pleater frame 18 which are not necessary to an understanding of the invention are deleted from FIG. 4 and the other drawings. However, one skilled in the art will understand, after a review of the disclosure, that suitable structural members necessry for support and load bearing, and for the support of specific elements or members outlined in the disclosure, are appropriately positioned within the pleater frame 18.

A horizontally curved member 20, preferably rigid, is mounted on pleater frame 18 downstream of and substantially coplanar with the vertically curved roller 16.

As used herein, "downstream" and like terms are used to designate the relative position of parts in relation to the movement of film 10 during normal operation of the invention, beginning with feeding film from roll 12, and following film 10 as it passes through or by various parts here and above described, and to be further described below, and ultimately to the means for gathering the pleated film.

The degree of curvature of the horizontally curved member may be determined by trial and error, or may be predetermined by calculations based on the positioning of rigid guides hereinafter discussed.

One skilled in the art will understand that the member 20 may be produced with a given fixed curvature, or suitable means may be employed to provide adjustment of the degree of curvature to optimize the operation of an apparatus in accordance with this invention.

In the preferred embodiment, the horizontally curved member 20 may be regarded as assuming an inverted D-shaped configuration, with the straight section of the member coplanar with the curved section, and an open area in between. Alternatively, an inverted D-shaped plate, such as a steel or aluminum plate, horizontally deployed, may function as the horizontally curved member 20.

Vertically below and parallel with the linear portion 22 of horizontally curved member 20, a linear member 24 is suspended between vertically disposed slide members 26. The slide members are in turn supported by the pleater frame 18.

Linear member 24 is equipped with a plurality of adjustable supports 28, which extend in cantilevered fashion from member 24 in a preferably substantially horizontal direction as shown in FIG. 4.

Each adjustable support 28 supports a respective rigid guide 30 preferably at its upper end.

A second linear member 32 is supported on pleater frame 18, and is preferably coplanar with horizontally curved member 20, and first feed roll 14.

Second linear member 32 is located on the side or horizontally curved member 20 opposite that of the vertically curved roller 16.

A second set of rigid guides 34 are disposed at spaced intervals beneath and affixed to member 32, preferably at their upper ends.

Members 34 are preferably curved at their upper ends so as to project in a direction towards first feed roll 14.

Rigid guides 30 and 34 are preferably of a metallic material such as steel. For materials such as steel, it is advantageous to cover portions of the guide that come in contact with the film with a protective material, such as glass fibers, or batting or blanket made therefrom. This procedure substantially reduces any adverse effect on the film that could result from moving contact between the film and the guides.

As arranged, in operation film 10 cascades down from curved member 20 and is pushed out, i.e. in convex fashion, where it contacts rigid guides 30. Interspersed in between rigid guides 30, the second set of rigid guides 34 performs the opposite function, i.e. creates a series of concave pleats in film 10 at portions of film 10 which contact this second set of rigid guides.

The result of film movement between the first set of rigid guides 30, and second set of rigid guides 34, is an alternating pleating or folding effect which begins gradually, and accentuates as the film is drawn further down between the rigid guides. This accentuation occurs because the guides are arranged in a generally V-shaped configuraiton and are closer together at the lower portion of the guides than at the upper portion.

Ultimately, at the bottom of pleater frame 18, end plates 35 accommodate horizontally guides 33 which support the lower end of respective film guides 30 and 34 and provide further channeling of the folded film by creating in effect channels for the folded film to pass through enroute to pinch rolls 36. After passing through the pinch rolls, the now pleated film is drawn past rolls 38, and tensioned roller 40, to a wind-up roller 42.

A tensioned dancer roll 40 provides regulated, tension-controlled off feeding of the now pleated film to wind up roll 42. Preferably, a roll follower 44 is also employed in contact with wind up roll 42 to improve the appearance and packing of the pleated film as it is wound on wind up roll 42.

An additional aspect of the present invention involves a method and apparatus for loading film roll 12 in order to quickly and easily feed the film pleater.

Referring to FIGS. 5, 6, 8, and 9, after a previous film roll 12 has been depleted during operation of the invention, a fresh film roll 12 is loaded into a J-shaped roll rack.

The roll rack 46 consists of a horizontal plate 48 on which a pair of J-shaped members 50 are welded or otherwise affixed. A suitable structural frame 52 connects the roll rack 46 to an axle 54 supported between pivoting members 56. A pneumatic air cylinder 58 is optionally installed along a central section of axis 54 to effect lifting of the roll rack 46 if required.

In operation, the fresh film roll 12 is placed manually on roll rack 46, which has been returned to an oblique position for convenience in loading.

Air cylinder 60 is activated to draw the frame 52 carrying the roll rack 46 and roll of film 12 into a vertical position.

If necessary, the roll of film may be raised vertically by activation of air cylinder 58.

A pair of horizontally disposed air cylinders 62 are fitted with cone shaped ends 64. When the roll 12 is brought to the desired vertical elevation, the horizontal cylinders 62 are activated to extend the cone shaped ends 64 of the respected horizontal cylinders 62 towards each other at the elevation of roll 12. Ends 64 engage the core 66 of roll 12, and force the roll 12 off the J-shaped members 50 to provide a freely moving roll for feeding into the pleater arrangement. A tensioning break 68 depicted schematically in FIG. 5 keeps the film 10 taut during operation.

While the film 10 can in some cases be fed from roll rack 46 without being lifted from members 50, it is preferred to have film roll 12 raised from members 50 to facilitate film feeding.

The present invention has been described in connection with preferred embodiments, but it should be understood that modifications may be made without departing from the principles and scope of the invention, as those skilled in the art will readily understand. Accordingly, such modifications may be practiced within the scope of the following claims.

For example, it should be understood that the number and spacing of film guides can be adjusted depending on the original dimensions of the roll stock film and the desired dimensions of the finished packaged film. Of course, such adjustments will dictate corresponding modification of the gathering means and other affected components of the film folding apparatus.

What is claimed is:

1. An apparatus for feeding film from a roll and folding said film to a desired width, comprising:

(a) a rigid frame;

(b) a vertically curved member mounted on said frame;

(c) a horizontally curved member mounted on said frame and substantially coplanar with said vertically curved member;

(d) a first linear member mounted on said frame below said horizontally curved member;

(e) a second linear member mounted on said frame downstream of and substantially coplanar with said horizontally curved member;

(f) a first series of rigid guides affixed at their upper ends to the first linear member at spaced intervals along said member, and at their lower ends to a first series of horizontal guides;

(g) a second series of rigid guides affixed at their upper ends to the second linear member at spaced intervals along said member and horizonally offset from said first series of guides at their respective lower ends, said second series of rigid guides affixed at their lower ends to a second series of horizontal guides parallel to and spaced apart from said first series of horizontal guides; and (h) said rigid guides disposed so as to contact film feeding from the horizontally curved member and causing folding of the film, said guides disposed closer together at their lower end than at their upper end.

2. The apparatus according to claim 1 wherein the vertically curved member is a roller.

3. The apparatus according to claim 1 wherein the vertically curved member is mounted along the top of said frame.

4. The apparatus according to claim 1 wherein the horizontally curved member is located downstream of said vertically curved member and along the top of said frame.

5. The apparatus according to claim 1 wherein the rigid guides of the second series are curved inwardly at their upper end to an extent sufficient to insure contact with and folding of the film.

6. The apparatus according to claim 1 wherein the number of rigid guides corresponds to the number of folds desired in the folded film.

* * * * *